US009327891B2

(12) United States Patent
Brandow

(10) Patent No.: US 9,327,891 B2
(45) Date of Patent: May 3, 2016

(54) TAMPER RESISTANT BLISTER PACK

(71) Applicant: Hub Folding Box Company, Inc., Mansfield, MA (US)

(72) Inventor: Bryon C. Brandow, Marion, MA (US)

(73) Assignee: Hub Folding Box Company, Inc., Mansfield, MA (US)

( * ) Notice: Subject to any disclaimer, the term of this patent is extended or adjusted under 35 U.S.C. 154(b) by 0 days.

(21) Appl. No.: 14/288,817

(22) Filed: May 28, 2014

(65) Prior Publication Data

US 2015/0329258 A1 Nov. 19, 2015

Related U.S. Application Data

(60) Provisional application No. 61/829,080, filed on May 30, 2013.

(51) Int. Cl.
*B65D 73/00* (2006.01)
*B31B 17/60* (2006.01)

(52) U.S. Cl.
CPC ..... *B65D 73/0092* (2013.01); *B31B 17/60* (2013.01)

(58) Field of Classification Search
CPC ..... B31B 17/60; B65D 73/0057; B65D 73/0092; B65D 75/32; B65D 75/36; B65D 75/366; B65D 83/04
USPC ..... 206/462, 461, 463, 469
See application file for complete search history.

(56) References Cited

U.S. PATENT DOCUMENTS

| | | | | |
|---|---|---|---|---|
| 3,462,066 | A | 8/1969 | Farquhar | |
| 5,088,603 | A | 2/1992 | Kirkpatrick | |
| 6,070,790 | A | 6/2000 | Anderson | |
| 6,918,532 | B2 | 7/2005 | Sierra-Gomez et al. | |
| 7,051,876 | B2 | 5/2006 | Grosskopf | |
| 7,063,211 | B2 * | 6/2006 | Williams-Hartman | 206/532 |
| 7,387,206 | B2 | 6/2008 | Grosskopf | |
| 7,448,496 | B2 * | 11/2008 | Williams-Hartman | 206/532 |
| 7,681,733 | B2 | 3/2010 | Grosskopf | |
| 7,726,481 | B2 | 6/2010 | Grosskopf | |
| 7,748,535 | B2 | 7/2010 | Grosskopf | |
| 7,758,287 | B2 | 7/2010 | Alm et al. | |
| 7,784,250 | B2 | 8/2010 | Grosskopf | |

(Continued)

FOREIGN PATENT DOCUMENTS

| | | | |
|---|---|---|---|
| EP | 2067714 | A1 * | 6/2009 |
| EP | 2277796 | A2 * | 1/2011 |

(Continued)

OTHER PUBLICATIONS

BlisterGuard® Brochure (dated no later than May 27, 2014).

*Primary Examiner* — Bryon Gehman

(74) *Attorney, Agent, or Firm* — Fish & Richardson P.C.

(57) ABSTRACT

Disclosed is a tamper resistant blister pack having a paperboard assembly attached to, and surrounding, at least a part of a flange on the blister (window element). An upper ply of the assembly is attached to an upper side of the flange. Additionally, although in some instances not necessary, a lower ply is attached to the lower side of the flange. The plies of the assembly have a paperboard layer, an upper film layer laminated to an upper side of the paperboard layer and a lower film layer laminated to a lower side of the paperboard layer. These layers and their attachment to the blister provide tear resistance without crisscrossing film orientation. Methods of making the pack are also disclosed.

23 Claims, 3 Drawing Sheets

(56) References Cited

U.S. PATENT DOCUMENTS

| | | | | |
|---|---|---|---|---|
| 7,845,496 | B2 | 12/2010 | Hession | |
| 7,905,355 | B2 * | 3/2011 | Williams-Hartman | 206/532 |
| 7,919,171 | B2 | 4/2011 | Young | |
| 7,980,390 | B2 * | 7/2011 | Hession et al. | 206/462 |
| 8,151,988 | B2 * | 4/2012 | Smith et al. | 206/462 |
| 8,251,214 | B2 * | 8/2012 | Wade | 206/462 |
| 8,342,330 | B2 | 1/2013 | Weston et al. | |
| 8,708,146 | B2 * | 4/2014 | Falcon | 206/462 |
| 2012/0318695 | A1 * | 12/2012 | Seber | B65D 75/22 206/461 |
| 2013/0341232 | A1 * | 12/2013 | Mikula | 206/462 |

FOREIGN PATENT DOCUMENTS

| | | | |
|---|---|---|---|
| GB | 2218072 | A * | 11/1989 |
| WO | WO 2008/058046 | A2 * | 5/2008 |

* cited by examiner

TAMPER RESISTANT BLISTER PACK

CROSS-REFERENCE TO RELATED APPLICATIONS

This application claims priority to U.S. Application Ser. No. 61/829,080, filed on May 30, 2013.

TECHNICAL FIELD

This invention relates to product packaging and more particularly to tear-resistant packaging for consumer products, particularly value-added products that are prone to shoplifting.

BACKGROUND

In-store theft of value-added products such as personal care products, small electronics and ink cartridges is widespread. A common practice to prevent in-store theft has been to remove the product from the store shelf and place it behind the counter in a secure area. It has been demonstrated that lack of shelf presence can adversely affect product sales.

Another common practice has been to lock the package in a clear plastic container. The consumer needs to take the container to the store clerk, have it unlocked, and then purchase the item. This process is not consumer friendly, is time consuming and adds additional costs associated with each sale.

Another common practice to prevent theft is attaching a tracking device, such as an RFID chip, to the package. If the thief tries leaving the store an alarm is sounded. This preventative measure does not work if the item is removed from the package, the packaging is left on the shelf and the item is concealed in clothing or a handbag.

Another common practice has been to keep value added products on the shelf in packaging which is designed to be easily seen by store clerks and sized to be difficult to conceal in clothing or handbags. However theft can occur by tearing open the packaging, removing the small item, and then concealing the product in clothing or a hand bag.

As a result there is a need to provide a blister package which not only is more easily visible to store clerks but will also have a tear resistance strong enough to alert store clerks and consumers that a thief is removing an item from the carton in order to conceal it in clothing or a handbag. Chances of in-store theft are drastically reduced if it becomes apparent that a thief is noticeably struggling to open the package in order to remove the item.

U.S. Pat. No. 7,051,876 issued to Colbert Packaging discloses clamshell packaging for displaying and housing products. The packaging includes a tear-resistant housing that encloses a display chamber. Tear resistance is achieved by adhering an oriented cross grain laminated film or other substrates with cross-grain properties on a single side of a paperboard substrate to provide cut or tear resistance in multiple directions.

SUMMARY

In one aspect the invention generally features a tamper resistant container having a tear resistant clear polymer window element (commonly known as a blister), which has a viewing area and a flange, and a paperboard assembly attached to, and surrounding, at least a part of the window element flange. The paperboard assembly includes an upper ply and a lower ply. At least the upper ply is sealed to an upper surface of the flange. Each ply has a paperboard layer, an upper film layer laminated to an upper side of the paperboard layer and a lower film layer laminated to a lower side of the paperboard layer.

In preferred embodiments, the lower film layer of the upper ply is sealed to the upper surface of the window element flange. The upper film layer of the lower ply may be sealed to a lower surface of the window element flange.

Also in preferred embodiments, at least a peripheral portion of the lower film layer of the upper ply is attached to at least a peripheral portion of the upper film layer of the lower ply, sealing the two plies around at least a portion of their peripheries. The paperboard assembly can be a single card folded to form the upper ply and the lower ply or it can be two separate cards, the upper ply comprising a first card, attached to the upper side of the flange and the lower ply comprising a second card, attached to the upper element and to the lower side of the flange.

A product may be housed in and viewable through the window element.

The paperboard layers preferably are paperboard base stock between 0.006 and 0.040 inches thick, for example, Solid Bleached Sulphate (SBS), Solid Unbleached Sulphate (SUS), and Clay Coated News (CCN).

The laminated film may be linear low density polyethylene, low density polyethylene, medium density polyethylene, high density polyethylene, polypropylene and polyethylene terephthalate. The film is either non-oriented or oriented film. If it is oriented, the orientation of the upper film layers is substantially the same as the orientation of the lower film layers.

The paperboard assembly has an MD tear resistance of at least 520, and a CD tear resistance of at least 570, measured by TAPPI Test Method T414, Internal Tearing Resistance of Paper and expressed in units of gram force.

Another aspect of the invention features a method of forming the above-described container by sealing (e.g. heat sealing) the upper flange surface to the lower film layer of the upper ply. Additionally, although in some instances it is not necessary, the lower flange surface is sealed (e.g. heat sealed) to the upper film layer of the second (lower) ply. At least a portion of the periphery lower film layer of the upper ply may be sealed to at least a portion of the upper film layer of the lower ply.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
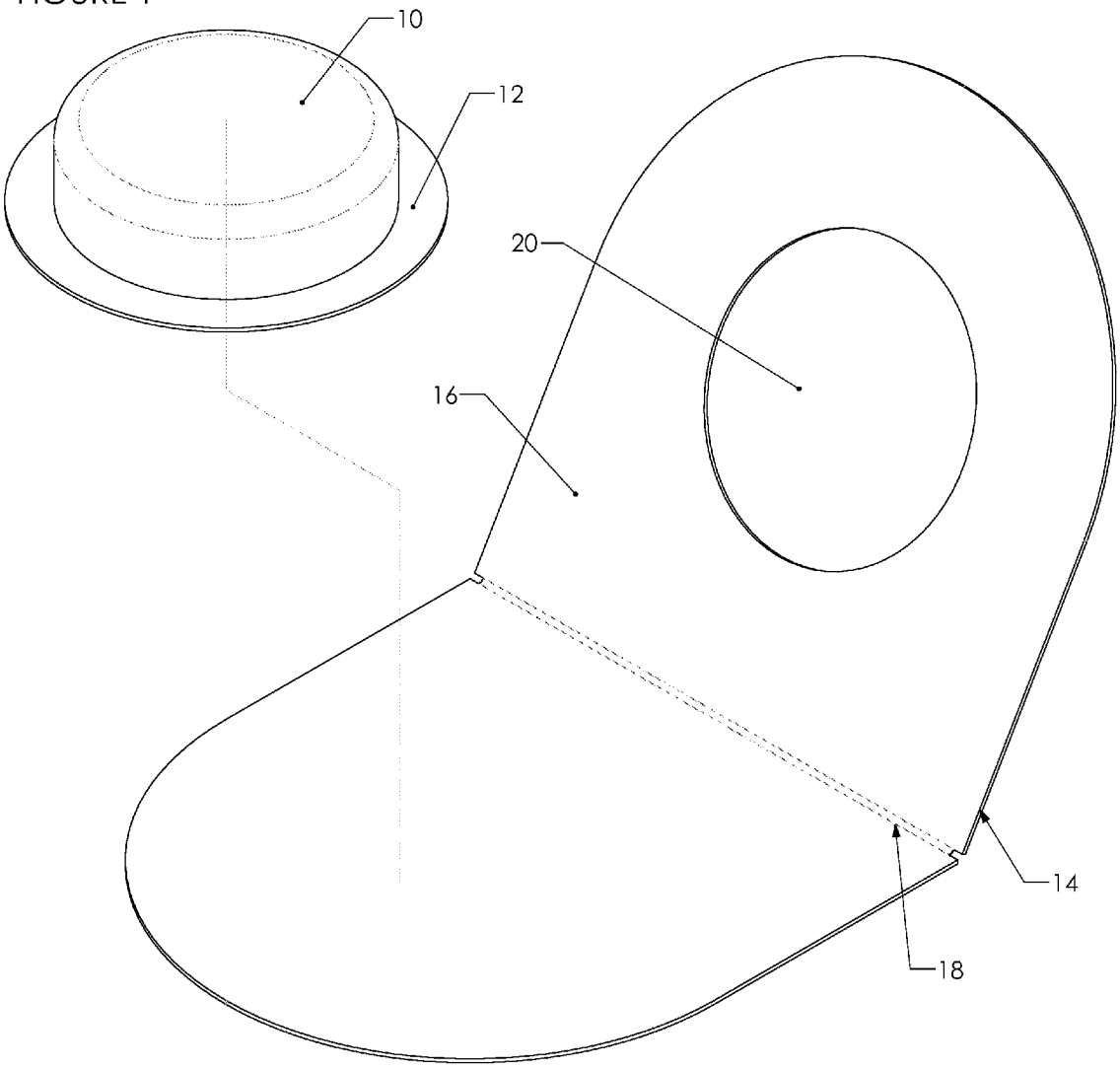
FIG. 1—A view of a single scored fold over card, with a die cut area sized to allow the blister (window element) to be inserted through the die cut area and trapped between the folds of the card.
Figure 2:
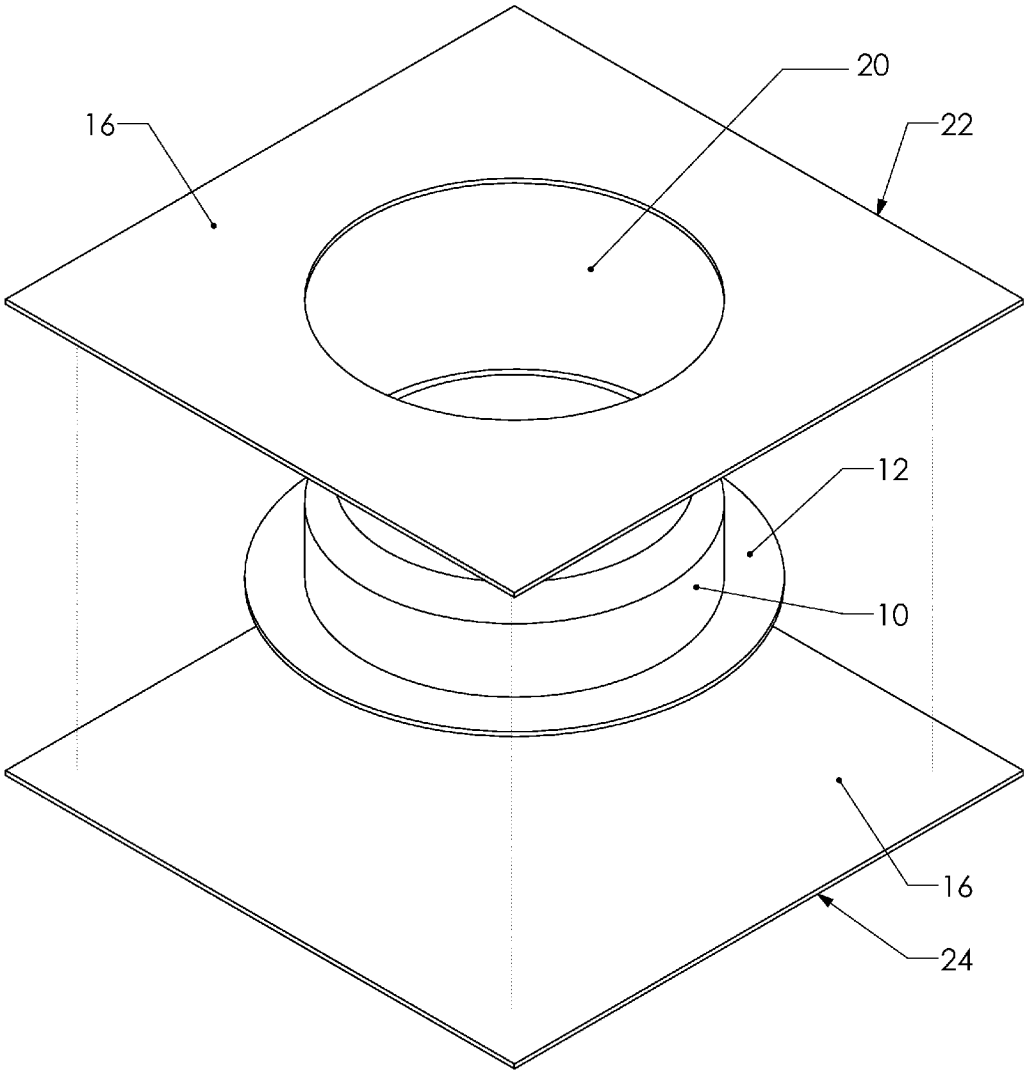
FIG. 2—A view of two cards with the top card having a die cut area sized to allow the blister (window element) from FIG. 1 to be inserted through the die cut area and trapped between the two cards.
Figure 3:
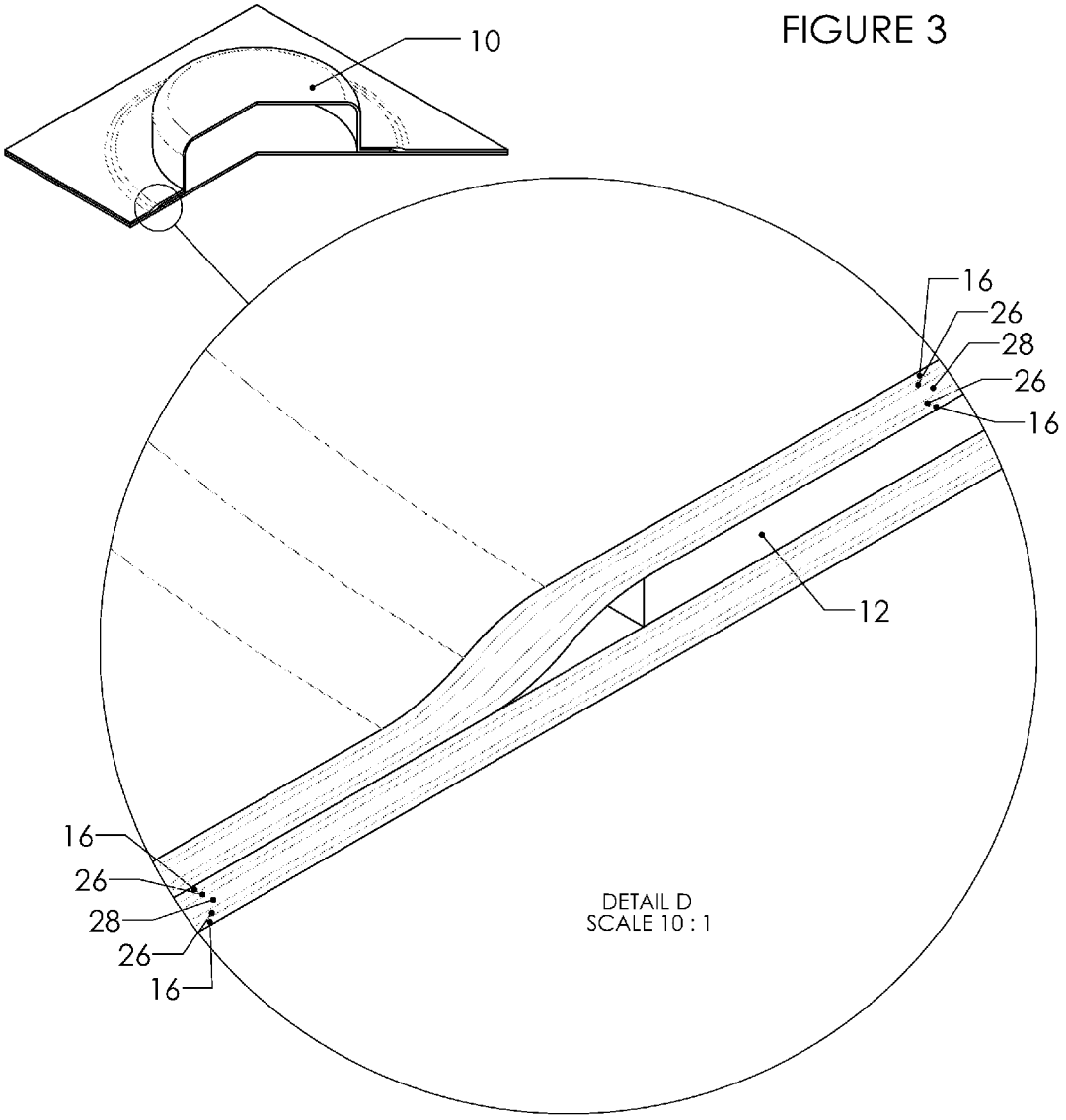
FIG. 3—A cross section of a trapped blister package.

FIGS. 1-3 show a tear resistant trapped blister package having either a) (FIG. 2) two laminated cards (or plies) sealed to each other with one or more display housings (commonly referred to as a blister) trapped between the two cards and extending out of the die cuts area(s) of top or bottom card, or b) (FIG. 1) a tear resistant trapped blister container having a single laminated card folded over and sealed to itself, with one or more display housings trapped between the fold and extending out of the die cut area(s) of the card. The singled laminated card is scored to allow ease in folding.

FIG. 1 shows a composite ply 14 folded over a score 18 to create two plies that surround a blister (window element) 10 having a flange 12. Composite ply 14 consists of three layers shown in FIG. 3: card (paperboard) base stock 28 joined to tear resistant film 16 on both sides by adhesive layers 16. The card base stock 28 can be made from Solid Bleached Sulphate (SBS), Solid Unbleached Sulphate (SUS), Clay Coated News (CCN) or other paperboard base stocks commonly used for packaging. Calipers (thickness) can range from 0.006 to 0.040 inch.

Film 16 can be blown or cast film made from Linear Low Density Polyethylene (LLDPE), Low Density Polyethylene (LDPE), Medium Density Polyethylene (MDPE), High Density Polyethylene (HDPE), Polypropylene (PP) Polyester (PET), or other blown or cast films which when laminated to the paperboard provide an MD tear resistance of at least 520 and a CD tear resistance of at least 570.

The clear plastic tear resistant blister (window element) 10 is sized to fit through a die cut area 20 of the card, with an extended bottom flange 12 sized larger than the die cut area 20, allowing the blister to be trapped between the card layers. Blister material can be made of, but not limited to PP, HDPE, PVC or PET.

In FIG. 2, there are two composite plies, a top ply 22 and a bottom ply 24, surrounding the flange 12 of blister 10. Blister (window element) 10 fits within die-cut area 20.

Lamination of the film to paperboard can be accomplished using an extrusion process which applies an adhesive molten resin between the paperboard and films thus bonding the three substrates together, or it can be accomplished using an aqueous adhesive between the paperboard and films. Methods used to seal blister cards to themselves and the blister flange include, but not limited to, using an adhesive or directly sealing with heat and pressure, infrared, ultrasonic, ultraviolet and radio frequency.

The films 16 are by themselves inherently heat sealable and therefore both the materials and the process of forming the container from them are economical. For example, flange 12 may be directly sealed to the composite ply 14 by heat sealing the film layer 16 to the flange.

Typically, but not necessarily in all cases, a peripheral seal between the two plies is achieved by heat sealing the peripheral segment (about ¼ inch) of the two plies—i.e., the lower layer of the upper ply to the upper layer of the lower ply.

The above-described configurations provide effective tear resistance by laminating films to both the top side and backside of the paperboard. There is no need to use a crisscross pattern of oriented films or to include an additional top coating on the film to achieve an appropriate seal.

To evaluate the tamper resistance, we measure tear resistance using TAPPI Test Method T414, Internal Tearing Resistance of Paper (Elmendorf method). In all cases we report tear resistance in units of gram force. One way to evaluate the product is to measure the tear resistance of a single ply. We measured tear resistance in the machine direction (MD) and in the cross direction (CD) of five different single ply SBS sheets, laminated with LLDPE films. Units are in gram force.

Single Ply Tear Resistance
1600 g Pendulum Used

| Sample ID | | 1 | 2 | 3 | 4 | 5 | Average | Std. Dev. |
|---|---|---|---|---|---|---|---|---|
| LLDPE Sample #1 | MD | 744 | 741 | 638 | 666 | 672 | 692 | 48 |
| | CD | 648 | 630 | 662 | 666 | 683 | 658 | 20 |
| LLDPE Sample #2 | MD | 638 | 645 | 618 | 610 | 618 | 626 | 15 |
| | CD | 883 | 683 | 686 | 744 | 784 | 756 | 83 |
| LLDPE Sample #3 | MD | 542 | 522 | 693 | 550 | 659 | 593 | 77 |
| | CD | 707 | 579 | 662 | 609 | 571 | 626 | 58 |

We prefer to use sheets having a single-ply a tear resistance of at least 500 in the machine direction and 600 in the cross direction. More preferably the tear resistance should be at least 600 in the machine direction and 700 in the cross direction. Of course the multi-ply configuration we describe below will have greater tear resistance.

We measured the tear resistance of a two-ply construct when tearing through the sealed peripheral portion. We measured tear resistance in the machine direction (MD) and in the cross direction (CD) of five different two ply SBS sheets, laminated LLDPE film. Units are in gram force.

Double Ply Tear Resistance
3200 g Pendulum Used

| Sample ID | | 1 | 2 | 3 | 4 | 5 | Average | Std. Dev. |
|---|---|---|---|---|---|---|---|---|
| LLDPE Sample #1 | MD | 1891 | 1878 | 1830 | 2029 | 1824 | 1891 | 83 |
| | CD | 2099 | 1878 | 1884 | 2029 | 1779 | 1934 | 128 |
| LLDPE Sample #2 | MD | 1619 | 1594 | 1798 | 1632 | 2070 | 1743 | 200 |
| | CD | 1872 | 1910 | 1885 | 2230 | 1824 | 1944 | 163 |
| LLDPE Sample #3 | MD | 1754 | 1817 | 1645 | 1709 | 1891 | 1763 | 95 |
| | CD | 1933 | 1837 | 1798 | 1760 | 1856 | 1837 | 65 |

In general we prefer to use paperboard assemblies in which the overall tear resistance as described above (assuming two plies) is at least 1600 in the machine direction and 1700 in the cross direction. More preferably the tear resistance under these conditions is at least 1700 in the machine direction and 1900 in the cross direction.

A number of embodiments of the invention have been described. Nevertheless, it will be understood that various modifications may be made without departing from the spirit and scope of the invention. For example, face-seal blister packaging involves heat sealing a preformed plastic dome or blister onto the face of a single film laminated paperboard card. Accordingly, other embodiments are within the scope of the following claims.

What is claimed is:

1. A tamper resistant container comprising, a tear resistant clear polymer window element comprising a viewing area and a window element flange, a paperboard assembly sealed to, and surrounding, at least a part of the window element flange, the paperboard assembly comprising, an upper ply sealed to an upper surface of the window element flange, the upper ply comprising a first paperboard layer, a first, upper layer of film laminated to an upper side of the first paperboard layer and a first, lower layer of film laminated to a lower side of the first paperboard layer, and a lower ply sealed to a lower surface of the window element flange, the lower ply comprising a second paperboard layer, a second, upper layer of film laminated to an upper side of the second paperboard layer and a second, lower layer of film laminated to a lower side of the second paperboard layer, and wherein the film is an oriented film, and the orientation of the upper layers of film is substantially the same as the orientation of the lower layers of film.

2. The container of claim 1 in which the lower layer of film of the upper ply is sealed to the upper surface of the window element flange.

3. The container of claim 2 in which the upper layer of film of the lower ply is sealed to a lower surface of the window element flange.

4. The container of claim 1 in which at least a peripheral portion of the lower film layer of the upper ply is sealed to at least a peripheral portion of the upper layer of film of the lower ply.

5. The container of claim 1 in which the paperboard assembly comprises a single card folded to form the upper ply and the lower ply, with at least the upper ply sealed to the window element flange.

6. The container of claim 1 in which the paperboard assembly comprises a first ply, sealed to the upper side of the window element flange and a second ply, separate from the first ply, sealed to the lower side of the window element flange and to the first ply.

7. The container of claim 1 comprising a product housed in and viewable through the window element.

8. The container of claim 1 in which the paperboard assembly comprises paperboard base stock.

9. The container of claim 8 in which of the paperboard base stock is between 0.006 and 0.040 inch thick.

10. The container of claim 1 in which the paperboard base stock is selected from the group consisting of solid bleached sulphate (SBS), solid unbleached sulphate (SUS), and clay coated news (CCN).

11. The container of claim 1 in which the film is selected from the group consisting of linear low density polyethylene, low density polyethylene, medium density polyethylene, high density polyethylene, polypropylene and polyethylene terephthalate.

12. The container of claim 1 in which a single ply of the paperboard assembly has a machine direction tear resistance of at least 500, measured by TAPPI Test Method T414, Internal Tearing Resistance of Paper and expressed in units of gram force.

13. The container of claim 1 in which a single ply of the paperboard assembly has a preferred machine direction tear resistance of at least 600, measured by TAPPI Test Method T414, Internal Tearing Resistance of Paper and expressed in units of gram force.

14. The container of claim 1 in which a single ply of the paperboard assembly has a cross direction tear resistance of at least 600, measured by TAPPI Test Method T414, Internal Tearing Resistance of Paper and expressed in units of gram force.

15. The container of claim 1 in which a single ply of the paperboard assembly has a preferred cross direction tear resistance of at least 700, measured by TAPPI Test Method T414, Internal Tearing Resistance of Paper and expressed in units of gram force.

16. The container of claim 1 in which a two-ply of the paperboard assembly has a machine direction tear resistance of at least 1600, measured by TAPPI Test Method T414, Internal Tearing Resistance of Paper and expressed in units of gram force.

17. The container of claim 1 in which a two-ply of the paperboard assembly has a preferred machine direction tear resistance of at least 1700, measured by TAPPI Test Method T414, Internal Tearing Resistance of Paper and expressed in units of gram force.

18. The container of claim 1 in which a two-ply of the paperboard assembly has a cross direction tear resistance of at least 1700, measured by TAPPI Test Method T414, Internal Tearing Resistance of Paper and expressed in units of gram force.

19. The container of claim 1 in which a two-ply of the paperboard assembly has a preferred cross direction tear resistance of at least 1900, measured by TAPPI Test Method T414, Internal Tearing Resistance of Paper and expressed in units of gram force.

20. A method of producing the container of claim 1 comprising sealing the upper surface of the window element flange to the first, lower layer of film of the upper ply.

21. The method of claim 20 further comprising sealing the lower surface of the window element flange to the second, upper layer of film of the lower ply.

22. The method of claim 20 further comprising sealing at least a portion of the periphery of the first, lower layer of film of the upper ply to at least a portion of the second, upper layer of film of the lower ply.

23. A tamper resistant container comprising, a tear resistant clear polymer window element comprising a viewing area and a window element flange, a paperboard assembly sealed to, and surrounding, at least a part of the window element flange, the paperboard assembly comprising, an upper ply sealed to an upper surface of the window element flange, the upper ply comprising a first paperboard layer, a first, upper layer of film laminated to an upper side of the first paperboard layer and a first, lower layer of film laminated to a lower side of the first paperboard layer, and a lower ply sealed to a lower surface of the window element flange, the lower ply comprising a second paperboard layer, a second, upper layer of film laminated to an upper side of the second paperboard layer and a second, lower layer of film laminated to a lower side of the second paperboard layer, and wherein the film is a non-oriented film with no fixed orientation.

* * * * *